United States Patent [19]

Ferrill

[11] Patent Number: 4,795,069

[45] Date of Patent: Jan. 3, 1989

[54] CLIP-COLLAR FOR SECURITY BADGES

[76] Inventor: Howard M. Ferrill, 16010 Torry Pines, Houston, Tex. 77062

[21] Appl. No.: 749,983

[22] Filed: Jul. 1, 1985

[51] Int. Cl.[4] ..... A45F 3/02

[52] U.S. Cl. ..... 224/202; 224/257; D24/20

[58] Field of Search ..... 224/202, 257; D24/20

[56] References Cited

U.S. PATENT DOCUMENTS 2,807,328 9/1957 Gould ..... D24/20

3,797,075 3/1974 Seron ..... 224/202

*Primary Examiner*—Henry J. Recla

*Attorney, Agent, or Firm*—Michael P. Breston

[57] ABSTRACT

The clip-collar for carrying an identification member comprises a limp band and a clip for joining the opposite ends of the band to form the collar. The clip has a strap portion adapted to receive and support the clasp of an identification member. The band is made of a flexible tubular plastic material, the opposite ends of which form sockets for forcibly receiving therein the hooks on the opposite ends of the clip.

1 Claim, 1 Drawing Sheet

CLIP-COLLAR FOR SECURITY BADGES

BACKGROUND OF THE INVENTION

1. Field of the Invention

This invention relates to collars for carrying identification badges or control cards such as are exhibited within security premises by employees and visitors.

2. Description of the Prior Art

In order to protect proprietary information, it has become accepted practice in both business and government to require identification and/or access control cards to be exhibited on the premises at all times by employees and visitors. When an employee is found without his badge in an area where he is not known, time-consuming difficulties with security personnel can be expected.

To comply with this requirement, identification cards must be worn in such a manner that they remain readily visible to security personnel at all times.

For this purpose, most identification cards or company badges are equipped with a clasp which allows the badge to become fastened to the wearer's clothing. However, different individuals attach the badges to different garment parts: pockets, collars, belts, etc. Some such places do not allow for ready card visibility.

A different kind of problem is due to the fact that many people are reluctant to clip their badges onto their clothing because doing so may cause damage to the fine fabrics of their garments.

Another frequent problem is that a security badge is often attached to an outer garment such as a coat, jacket or sweater, and the badge is inadvertently left attached on the garment when it is removed from the body.

To avoid some of the above-indicated drawbacks, a security badge is sometimes worn on a bead-chain which extends through a hole in a claspless badge. However, a beaded chain is undesirable because it allows the badge to easily swing with body movements, a condition which is distracting and sometimes even unsafe to the badge wearer. Also, beaded chains do not allow a badge to be continuously visible, because the badge is free to flip over on the beaded chain and hide its security information.

Therefore, it is a main object of the present invention to provide a new and improved security collar which is attractive in appearance, comfortable to wear around the neck or wrist, inexpensive to manufacture, and which avoids the above mentioned and other well-known drawbacks of the prior art collars for security badges and the like.

SUMMARY OF THE INVENTION

The novel clip-collar for carrying an identification member such as a badge or card comprises a limp tubular band whose opposite ends form sockets which are adapted to forcibly receive therein the free outer ends of a clip having a strap portion that can receive and hold the clasp of the identification member. The band is preferably made of a plastic material. The clip is generally U-shaped having a pair of legs and the strap therebetween. Each leg preferably has at its outer end a bent-over hook for forcibly engaging and bite into the wall of its mating socket.

DETAILED DESCRIPTION OF PREFERRED EMBODIMENTS

Figure 3:
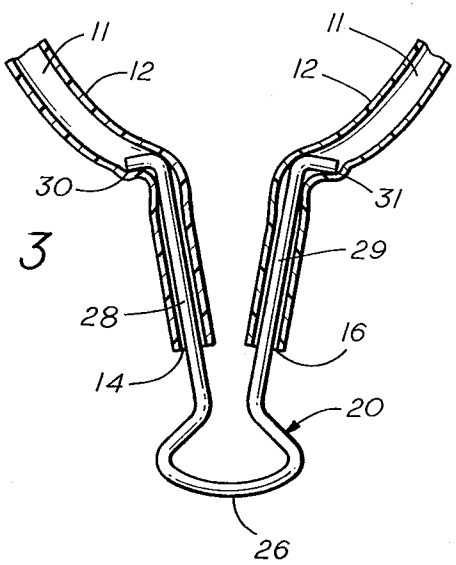
FIG. 3 is a fragmentary, partly sectional view of a preferred embodiment of the the clip-collar shown in FIG. 1.

With reference to the drawings, the clip-type collar 10 of this invention comprises a limp band 12, preferably made of a tubular flexible plastic material defining a bore 11. The opposite free ends of the tubular band form sockets 14, 16. A clip 20 is coupled to sockets 14, 16 to close the loop of band 12 thereby forming collar 10. The clip is preferably made of a piece of spring-type resilient wire formed into a curve for pulling the opposite ends of band 12 together thereby preventing accidental loss of badge 21.

An identification member such as a badge or card 21 normally carries a catch or clasp 22 on the back thereof for releasably coupling badge 21 to clip 20 of collar 10. Clasp 22 is typically of the spring-loaded type and includes two jaws 23, 24 and a bias spring 25 therebetween.

In a preferred embodiment shown in FIG. 3, clip 20 is generally U-shaped and has a straight strap portion 26 and a pair of legs 28, 29. Strap 26 is adapted to removably accept and support the jaws 23, 24 of a typical clasp 22 of an identification member 21. Strap 26 is curved and has a length such as to allow it to freely accept thereon the jaws of most clasps 22. The inner ends of legs 28, 29 of clip 20 are bent at an acute angle relative to strap 26 and their outer ends have L-shaped, outwardly-extending hooks 30, 31 which can be forcibly inserted into sockets 14, 16. Hooks 30, 31 bite into the sockets' resilient walls without rupturing them. If a downward pull should become exerted on strap 26, these hooks would further bite into the walls of said sockets thereby preventing a separation between clip 20 and band 12.

Figure 4:
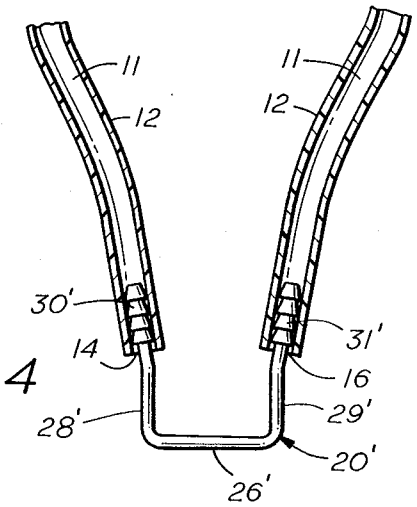
FIG. 4 is an enlarged fragmentary, partly sectional view of another embodiment of the the clip-collar shown in FIG. 1.
Figure 2:
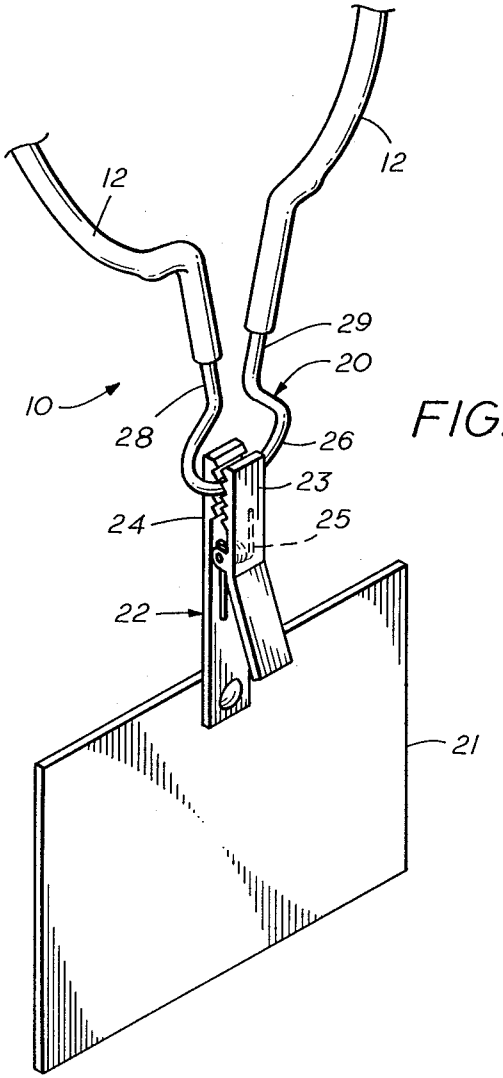
FIG. 2 is a view in perspective showing the manner of coupling the clip to the clasp of the badge.
Figure 1:
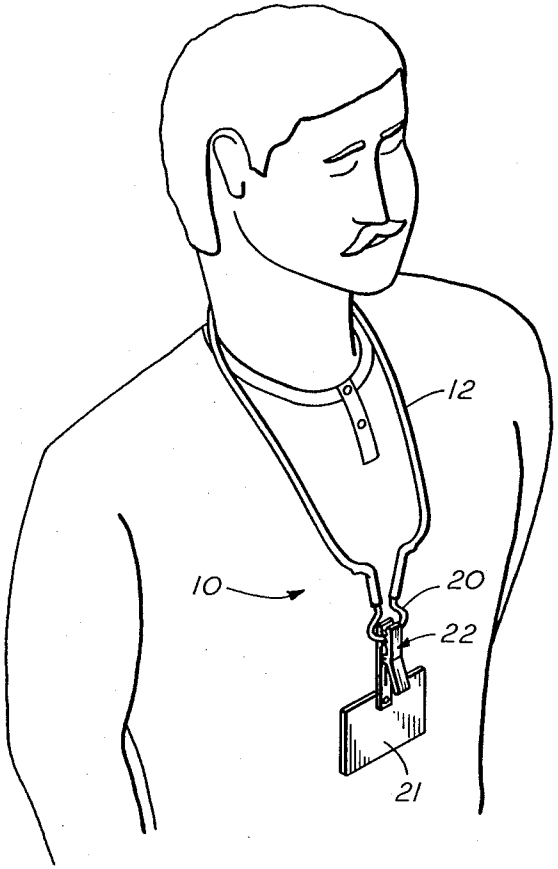
FIG. 1 is a perspective view of the clip-collar of the invention attached to a common security badge around the neck of a wearer.

In another embodiment (FIG. 4), the strap 26' is staight and legs 28', 29' are substantially perpendicular thereto. The outer ends of legs 28', 29' are slightly bent outwardly and formed into suitable plugs 30', 31' which are adapted to respectively become forcibly and securely accepted within the band's sockets 14, 16 so as to establish a press fit between the plugs and the walls of the sockets. In this manner clip 20 will ordinarily resist becoming detached from band 12.

Clip-collar 10 positions badge 21 in a manner as to enhance its visibility and it is especially beneficial in environments which utilize card readers for access control. In most instances, the identification badge or card 21 can be inserted into the card reader without the need to remove the badge from the collar. In those instances where the identification card must be removed from collar 10, a natural habit quickly develops to return the card to clip 20. This habit becomes reenforced because the joinder of metal clip 20 to its mating metal clasp 22 creates a natural sense of unity.

In fact, clip-collar 10 conveys a sense of organization in that it becomes an extension of badge 21 and greatly increases the inclination to wear the identification member 21.

It will be appreciated that clip-collar 10 of this invention has accomplished the objects set forth above, and in addition it will be apparent that collar 10 is esthetically pleasing and conveys a sense of purpose.

What is claimed is:

1. A collar for comfortably carrying around the neck an identification member to enhance its visibility, said member having a clasp which includes a pair of spring-biased jaws, said collar comprising:

a limp band made of a flexible tubular plastic material having a bore whose opposite ends form sockets;

a generally U-shaped clip made of spring-type resilient wire and having a substantially straight strap portion for removably accepting and supporting said jaws, and a pair of legs whose outer ends are bent to form outwardly-extending, L-shaped hooks, said legs being shaped so as to act as bias springs for said hooks which are adapted to become forcibly inserted into said sockets in laterally-opposite directions for hookingly engaging without rupturing the wall of said tube

* * * * *